US005180320A

United States Patent [19]

Calamia et al.

[11] Patent Number: 5,180,320

[45] Date of Patent: Jan. 19, 1993

[54] TRIM SWITCH FOR TILLER-STEERED OUTBOARD

[75] Inventors: David C. Calamia; Gregory J. Binversie, both of Grayslake, Ill.; H. Norman Petersen, Kenosha, Wis.

[73] Assignee: Outboard Marine Corporation, Waukegan, Ill.

[21] Appl. No.: 716,912

[22] Filed: Jun. 18, 1991

[51] Int. Cl.[5] ..... B63H 21/26

[52] U.S. Cl. ..... 440/61; 440/53

[58] Field of Search ..... 440/61, 84, 87, 53, 440/58-60; 200/837, 264, 512

[56] References Cited

U.S. PATENT DOCUMENTS 3,900,710 8/1975 Potter ..... 200/832 X 4,337,053 6/1982 Stevens ..... 440/87

4,582,493 4/1986 Toyohara et al. ..... 440/84

4,650,429 3/1987 Boda ..... 440/87

4,925,411 5/1990 Burmeistor ..... 440/61

FOREIGN PATENT DOCUMENTS 215493 10/1985 Japan ..... 440/53

*Primary Examiner*—Sherman Basinger

*Attorney, Agent, or Firm*—311h3el, Best & Friedrich

[57] ABSTRACT

A tiller arm for a marine propulsion device, the tiller arm comprising a first end adapted to be connected to a propulsion unit, a second end spaced from the first end, a longitudinal axis, and a selectively actuable switch including annular selectively deformable structure surrounding the axis, deformation of the deformable structure resulting in actuation of the switch.

17 Claims, 2 Drawing Sheets

TRIM SWITCH FOR TILLER-STEERED OUTBOARD

BACKGROUND OF THE INVENTION

The invention relates generally to tiller-steered marine propulsion devices. The invention also relates to trim switches for outboard motors.

It is known to use electrical switches to control the trim of an outboard motor. These electrical switches are typically provided on the motor cover or on an accessory panel in the boat.

An apparatus for controlling the trim of a marine propulsion device, is disclosed in U.S. patent application Ser. No. 07/523,321, filed May 14, 1990, now U.S. Pat. No. 5,049,098, issued Sep. 17, 1991, the specification of which is incorporated herein by reference, and which application is assigned to the assignee of the present invention.

It is also known to provide an engine "kill" switch on a tiller handle of an outboard motor. These switches are typically pushbutton type switches. It is also known to provide a throttle control on a tiller handle, the throttle control being rotatable about a longitudinal axis defined by the tiller handle. Attention is directed to U.S. Pat. No. 4,337,053, (Stevens) which shows such a kill switch and such a throttle control.

SUMMARY OF THE INVENTION

The invention provides a tiller arm for a marine propulsion device, the tiller arm comprising a first end adapted to be connected to a propulsion unit, a second end spaced from the first end, a longitudinal axis, and a selectively actuable switch including annular selectively deformable means surrounding the axis, deformation of the deformable means resulting in actuation of the switch.

One embodiment of the invention provides a marine propulsion device comprising a propulsion unit adapted to be mounted on the transom of a boat for pivotal movement about a generally horizontal tilt axis, selectively actuable means for adjusting the angle of the propulsion unit about the tilt axis, and a tiller arm which is connected to the propulsion unit and which includes a switch operatively connected to the selectively actuable means.

One embodiment of the invention provides a marine propulsion device comprising a propulsion unit adapted to be mounted on the transom of a boat for pivotal movement about a generally vertical steering axis, and for pivotal movement about a generally horizontal tilt axis, first selectively actuable means for adjusting the angle of the propulsion unit about the tilt axis in a first direction, second selectively actuable means for adjusting the angle of the propulsion unit about the tilt axis in a second direction, and a tiller arm including a first end connected to the propulsion unit, a second end spaced from the first end, a longitudinal axis, and a first electrical switch adjacent the second end of the tiller arm, the first switch being capable only of being in one of an open state and a closed state, being normally in the open state, and being operatively connected to the first selectively actuable means, and the tiller arm further including a second electrical switch adjacent the first electrical switch, the second switch being capable only of being in one of an open state and a closed state, being normally in the open state, and being operatively connected to the second selectively actuable means.

The invention provides an outboard motor with switches for adjusting the trim of the propulsion unit conveniently located on the tiller arm so that an operator of the outboard motor can adjust trim by squeezing a switch between his or her fingers without removing his or her hand from the handle of the tiller arm.

Other features and advantages of the invention will become apparent to those of ordinary skill in the art upon review of the following detailed description, claims, and drawings.

Figure 1:
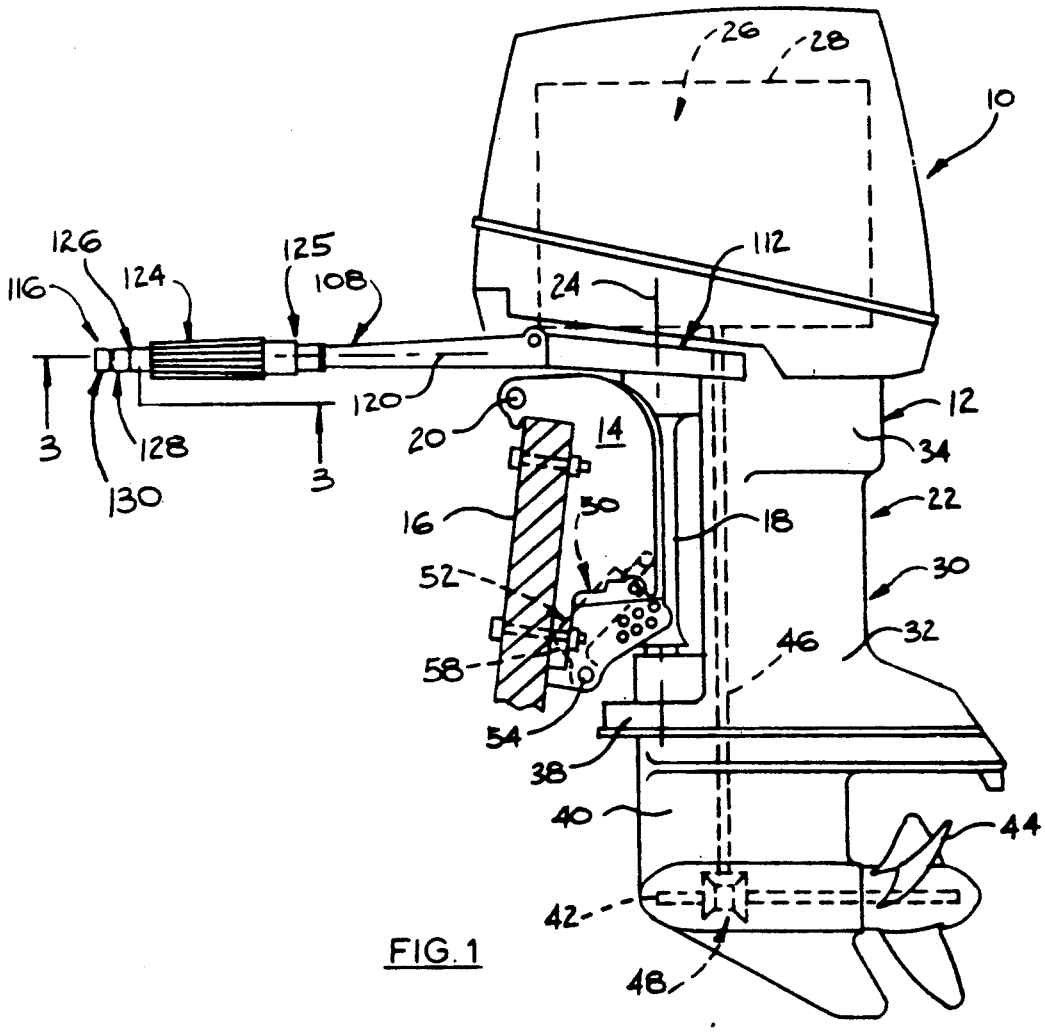
FIG. 1 is a side elevational view of a marine propulsion device which embodies various of the features of the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DETAILED DESCRIPTION OF THE PREFERRED EMBODIMENT OF THE INVENTION

FIG. 1 illustrates a marine propulsion device 10 which is in the form of an outboard motor 12 and which embodies various features of the invention. The outboard motor 12 includes a transom bracket 14 fixedly mounted to a boat transom 16, and a swivel bracket 18 which is pivotally mounted on the transom bracket 14 for vertical tilting movement about a generally horizontally extending tilt axis 20.

The outboard motor 12 also includes a propulsion unit 22 which is connected to the swivel bracket 18 for common movement therewith about the tilt axis 20 and for pivotal movement relative to the swivel bracket 18 about a generally vertical steering axis 24. The propulsion unit 22 comprises a power head 26, which includes an internal combustion engine 28, and a lower unit 30 including a drive shaft housing 32. The drive shaft housing 32 has an upper end 34 fixedly connected to the power head 26, and has a lower end 38. The lower unit 30 further includes a gear case 40 fixedly connected to the lower end 38 of the drive shaft housing 32. The lower unit 30 further includes a propeller shaft 42 supported by the gear case 40 for rotation relative thereto, and a propeller 44 carried by the propeller shaft 42. The propulsion unit 22 further comprises a vertically extending drive shaft 46 driven by the internal combustion engine 28. The propulsion unit 22 further comprises a reversing transmission 48 located in the gearcase 40 and connecting the drive shaft 46 to the propeller shaft 42. The internal combustion engine 28 drives the propeller shaft 42 through the drive shaft 46 and the reversing transmission 48.

The marine propulsion device 10 further includes selectively actuable means 50 for adjusting the angle of the propulsion unit 22 about the tilt axis 20 relative to the transom bracket 14. While other constructions can be employed, in the illustrated embodiment, the selectively actuable means 50 includes a hydraulic trim assembly 52 selectively pivoting the swivel bracket 18 and the connected propulsion unit 22 about the horizontal tilt axis 20 and relative to the transom bracket 14. The hydraulic trim assembly 52 includes (see FIG. 2) a hydraulic cylinder and piston assembly which is pivotally supported by a horizontal rod 54 fixed to the lower portion of the transom bracket 14 and which is engageable with the swivel bracket 18 to rotate the swivel bracket 18 about the tilt axis 20.

The hydraulic cylinder and piston assembly includes a cylinder 56 having a lower end, at which the cylinder and piston assembly is pivotally supported by the horizontal rod 54, and having an upper end. The hydraulic cylinder and piston assembly also includes a piston 58 slidably received within the cylinder 56 and dividing the cylinder into an upper chamber 60 and a lower chamber 62. The hydraulic cylinder and piston assembly further includes a piston rod 64 extending through the upper end of the cylinder 56 and having an upper end connected to the swivel bracket 18, and a lower end connected to the piston 58 for movement therewith.

In order to permit upward tilting movement of the propulsion unit 22 in the event that the propulsion unit 22 strikes an underwater obstruction, the piston 58 has therein a plurality of impact relief valves 74. When the propulsion unit 22 strikes an underwater obstruction, the upward tilting force exerted on the propulsion unit 22 increases the pressure in the upper cylinder chamber 60. When this pressure exceeds a predetermined level, the impact relief valves 74 open and permit fluid flow from the upper chamber 60 to the lower chamber 62, thereby permitting the piston 58 to move upwardly within the cylinder 56. This permits the piston rod 64 to extend, thereby permitting the propulsion unit 22 to tilt upwardly.

The selectively actuable means 50 further comprises means for selectively and alternatively extending and contracting the hydraulic assembly. This means includes means for selectively and alternatively supplying hydraulic fluid to the upper and lower chambers 60 and 62 of the cylinder 56.

Figure 2:
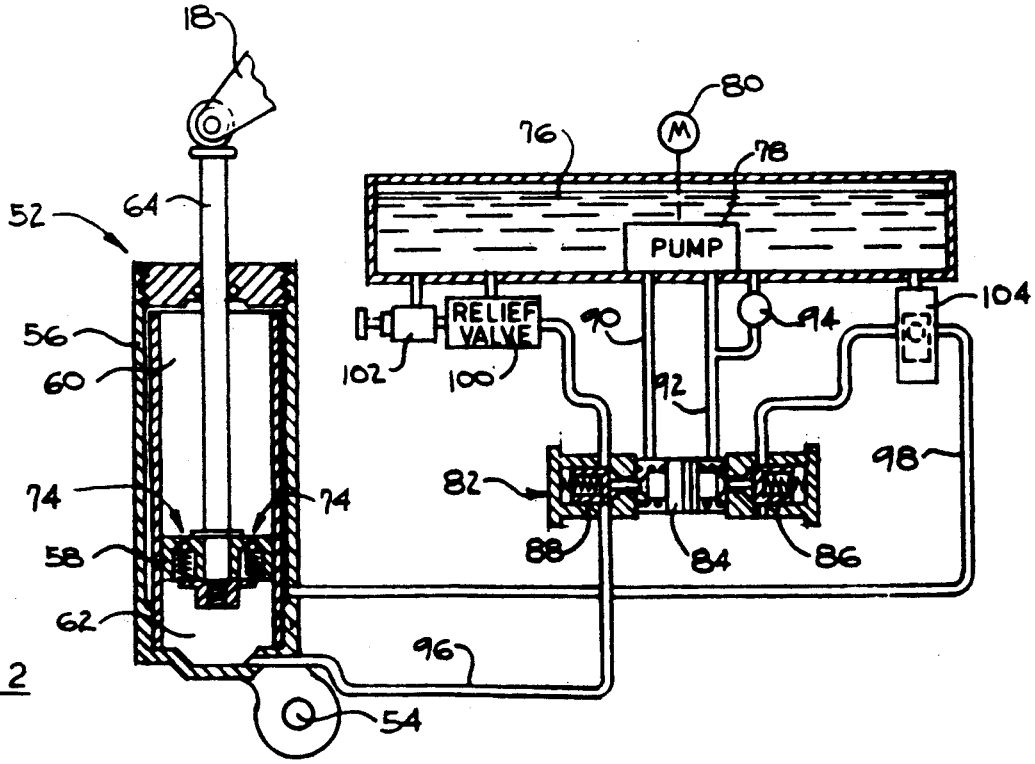
FIG. 2 is a schematic view of a hydraulic system, comprising a hydraulic cylinder-piston assembly, included in the marine propulsion device.

As is apparent from FIG. 2, supplying hydraulic fluid to the lower chamber 62 causes extension of the piston rod 64 and upward tilting movement of the swivel bracket 18 and propulsion unit 22, and supplying hydraulic fluid to the upper chamber 60 causes retraction of the piston rod 64 and downward tilting movement of the swivel bracket 18 and propulsion unit 22.

The means for selectively and alternatively supplying hydraulic fluid to the upper and lower chambers 60 and 62 of the cylinder 56 includes a fluid reservoir 76 and a reversible pump 78. The fluid supplying means further includes a reversible drive motor 80 controlling operation of the pump 78.

The pump 78 is connected to the cylinder 56 by a hydraulic circuit included in the fluid supplying means. The hydraulic circuit includes a shuttle piston valve 82 having left and right ends. The valve 82 includes a shuttle piston 84, a right check valve 86, and a left check valve 88.

The hydraulic circuit also includes a first passageway 90 communicating between the pump 78 and the left end of the valve 82, and a second passageway 92 communicating between the pump 78 and the right end of the valve 82. The hydraulic circuit also includes a relief valve 94 communicating between the second passageway 92 and the reservoir 76. The hydraulic circuit also includes a third passageway 96 communicating between the left end of the valve 82 and the lower cylinder chamber 62, and a fourth passageway 98 communicating between the right end of the valve 82 and the upper cylinder chamber 60.

When the motor 80 is actuated to drive the pump 78 in the forward direction, fluid is pumped to the left side of the shuttle piston 84 via the first passageway 90. This fluid moves the shuttle piston 84 to the right, thereby opening the right check valve 86 and causing communication between the second passageway 92 and the fourth passageway 98. At the same time, the pressure of the fluid in the passageway 90 opens the left check valve 88. This causes communication between the first passageway 90 and the third passageway 96 and permits the fluid to flow into the lower cylinder chamber 62, thereby causing the piston 58 to move upwardly. Upward movement of the piston 58 causes fluid to flow out of the upper cylinder chamber 60 and return to the reservoir via the fourth and second passageways 98 and 92, respectively.

When the motor 80 is actuated to drive the pump 78 in the reverse direction, fluid is pumped to the right side of the shuttle piston 84 via the second passageway 92, the shuttle piston 84 moves to the left, fluid flows from the pump 78 to the upper cylinder chamber 60 via the second and fourth passageways 92 and 98, respectively, and fluid flows from the lower cylinder chamber 62 to the reservoir 76 via the third and first passageways 96 and 90, respectively. The relief valve 94 opens if the piston 58 bottoms out.

The hydraulic circuit also includes a thermal relief valve 100, and a manual release valve 102 both communicating between the left end of the shuttle piston valve 82 and the reservoir 76. The thermal relief valve 100 prevents blocking of the hydraulic assembly as a result of extreme temperature changes, and the manual release valve 102 provides a means for relieving pressure in the hydraulic circuit if the hydraulic assembly fails. This permits manual lowering of the propulsion unit 22.

The hydraulic circuit also includes a filter valve 104 communicating between the fourth passageway 98 and the reservoir 76. The filter valve 104 compensates for the different volumes of fluid displaced in the upper and lower cylinder chambers 60 and 62 due to the volume of the piston rod 64.

In the illustrated construction, the reservoir 76, pump 78, motor 80, and hydraulic circuit are all integrally connected to and located with the hydraulic trim assembly 52 between the transom 16 and the swivel bracket 18.

Figure 4:
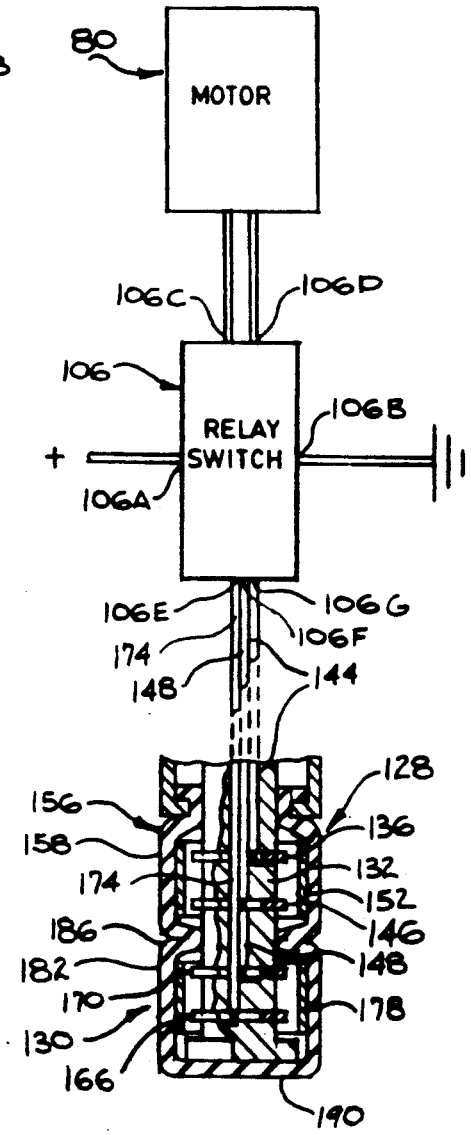
FIG. 4 is a circuit schematic of a circuit included in the marine propulsion device, which circuit controls the hydraulic cylinder-piston assembly of FIG. 2.

The selectively actuable means 50 further includes (see FIG. 4) a relay switch 106 having a first terminal 106A electrically connected to a positive terminal of a voltage source, having a second terminal 106B electrically connected to ground with regard to the voltage source, having third and fourth terminals 106C and 106D electrically connected to the motor 80, and having fifth, sixth, and seventh terminals 106E, 106F, and 106G. If the terminal 106F is electrically connected to the terminal 106G, the relay switch 106 drives current through the terminals 106C and 106D in a first direction, thereby causing the motor 80 to operate in a first direction. If the terminal 106F is electrically connected to the terminal 106E, the relay switch 106 drives current through the terminals 106C and 106D in a second direction opposite to the first direction, thereby causing the motor 80 to operate in a second direction opposite to the first direction. Thus, the selectively actuable means 50 alone defines a first selectively actuable means for adjusting the angle of the propulsion unit 22 about the tilt axis 20 in a first direction, such that the propeller 44 moves away from the transom 16, and defines a second selectively actuable means for adjusting the angle of the propulsion unit 22 about the tilt axis 20 in a second direction, such that the propeller 44 moves toward the transom 16.

An apparatus that is substantially identical to the selectively actuable means 50, excluding a relay, is disclosed in detail in Burmeister et al. U.S. Pat. No. 4,786,264, issued on Nov. 22, 1988, the specification of which is incorporated herein by reference.

The marine propulsion device 10 further comprises (see FIG. 1) a tiller arm 108 including a first or inner end 112 connected to the propulsion unit 22, and a second or outer end 116 spaced from the first end. The tiller arm defines a longitudinal axis 120. The tiller arm 108 further includes a handle 124 located adjacent the outer end 116 of the tiller arm 108. The handle 124 includes a grip that is twistable about the axis 120, twisting of the grip about the axis 120 resulting in the throttle of the engine 28 being adjusted. The handle 124 has a first or inner end 125 along the axis 120 proximal to the propulsion unit 22, and has a second or outer end 126 along the axis distal to the propulsion unit 22.

Figure 3:
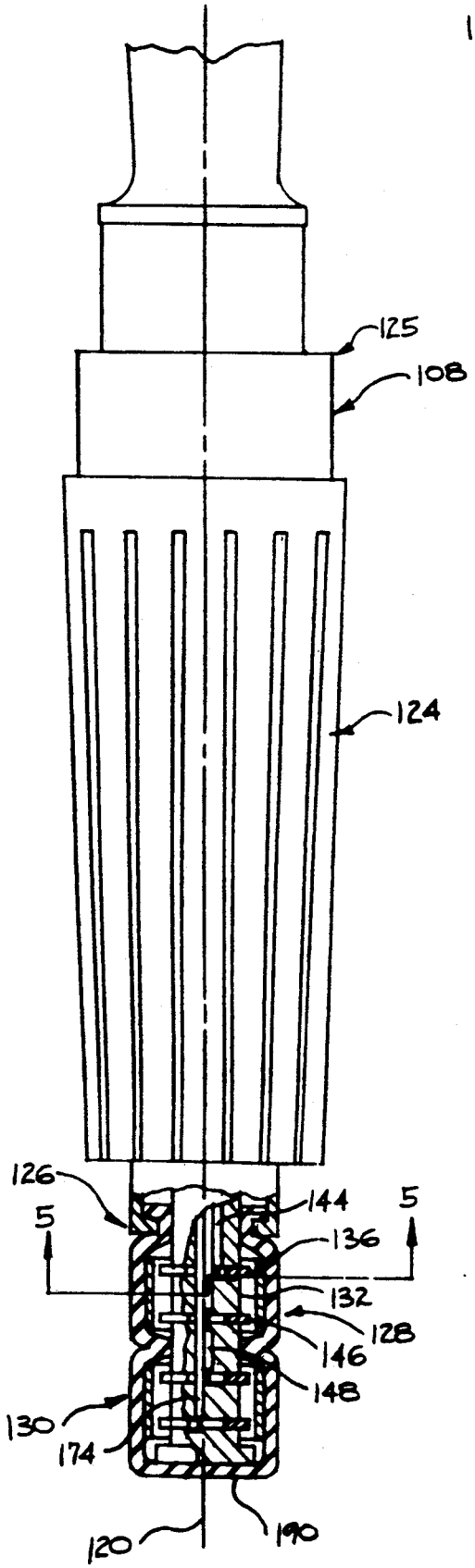
FIG. 3 is an enlarged, fragmentary sectional view of the tiller arm taken along line 3—3 of FIG. 1.

The tiller arm 108 further includes manually operable means for actuating the means 50. This manually operable means preferably includes (see FIG. 3) first and second electrical switches 128 and 130 adjacent to or defining a part of the handle 124. Each switch 128 or 130 is capable only of being in one of an open state and a closed state at any one time, and is normally in the open state.

The switch 128 is electrically connected to the terminals 106F and 106G of the relay switch 106. In the illustrated construction, the tiller arm 108 includes a plastic post 132 extending from the distal end of handle 124, the plastic post 132 supporting the switch 128 adjacent to the handle 124. More particularly, the switch 128 comprises a first electrical contact 136 electrically connected to the terminal 106G by a wire 144, and a second electrical contact 146 electrically connected to the terminal 106F by a wire 148. The first and second electrical contacts 136 and 146 are preferably defined by first and second brass washers, respectively, the washers 136 and 146 being supported by the post 132 as described below. The washer 146 is spaced from the washer 136 along the longitudinal axis 120 in a direction away from the inner end of the tiller arm. Each brass washer has therethrough (see FIG. 5) a hole 150, and has a circumference lying in a plane perpendicular to the longitudinal axis 120. The washers 136 and 146 are preferably centered on the axis 120, and preferably have equal outer diameters that are greater than the outer diameter of the plastic post 132. In this embodiment of the invention, the switch 128 further comprises annular selectively deformable electrically conductive means 152 radially surrounding and radially spaced from the washers 136 and 146. Preferably, the deformable means 152 is defined by a metal band in the shape of an open ended, hollow right cylinder having its axis aligned with the axis 120. The band 152 has a length along the axis 120 that is greater than the distance along the axis 120 by which the washer 136 is spaced from the washer 146. Deformation of the band 152 radially inwardly with regard to the longitudinal axis 120 results in the band 152 electrically connecting the washer 136 to the washer 146, resulting in the switch 128 being in the closed state. This causes extension of the hydraulic assembly 52 whereby the propeller 44 moves away from the transom 16.

The switch 130 is operatively connected to the terminals 106F and 106E of the relay switch 106. In the illustrated construction, the post 132 extends past the first switch 128 and supports the second switch 130. More particularly, the switch 130 comprises first and second electrical contacts 166 and 170. The first and second electrical contacts 166 and 170 are preferably defined by first and second brass washers, respectively, which are substantially identical to the washers 136 and 146. The washers 166 and 170 are supported by the post 132 as described below, the washer 170 being spaced from the washer 146 along the longitudinal axis 120 in the direction away from the handle 12, and the washer 166 being spaced from the washer 170 along the longitudinal axis 120 in the direction away from the handle 124. The washer 170 is electrically connected to the washer 146, and thus to the terminal 106F, by the wire 148. The washer 166 is electrically connected to the terminal 106E by a wire 174.

The switch 130 further comprises annular, selectively deformable, electrically conductive means 178 radially surrounding and radially spaced from the washers 166 and 170. Preferably, the deformable means 178 is defined by a metal band that is identical to the band 152. The band 178 is spaced from the band 152 in the direction along the axis 120. The band 178 has a length along the axis 120 that is greater than the distance along the axis 120 by which the washer 166 is spaced from the washer 170. Deformation of the band 178 radially inwardly with regard to the longitudinal axis 120 results in the band 178 electrically connecting the first washer 166 to the second washer 170, resulting in the switch 130 being in the closed state and resulting in contraction of the hydraulic assembly 52 whereby the propeller 44 moves toward the transom 16.

The tiller arm 108 further includes (see FIG. 4) a deformable dielectric sheath 156 axially extending from and supported by the handle 124. The sheath 156 has a first portion 158 radially surrounding the metal band 152 and attached to the metal band 152. The sheath 156 further includes a second portion 182 which is spaced from the first portion 158 along the axis 120 and which radially surrounds the metal band 178. The second portion 182 of the sheath is attached to the metal band 178. The sheath 156 is sufficiently rigid, at least in portions, to normally locate the metal band 152 in its normal position radially spaced from and surrounding the washers 136 and 146, and to normally locate the metal band 178 in its normal position spaced from and surrounding the washers 166 and 170. The sheath 156 is preferably formed of rubber. The sheath 156 preferably includes an inwardly extending or recessed portion 186 electrically isolating the band 152 from the band 178 and providing a visual indicia to the operator of the marine propulsion device 10 as to where the switch 128 is separated from the switch 130. The sheath 156 may be physically attached to the post 132 at the recessed portion 186. The sheath 156 further includes an end wall 190 which is transverse to the axis 120 and which covers the end of the post 132 away from the handle 124. The sheath 156 and handle 124 define means for insulating the switches 128 and 130 from water.

Figure 5:
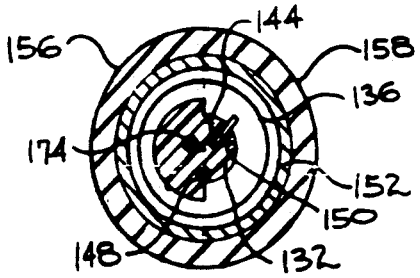
FIG. 5 is an enlarged sectional view of the tiller arm taken along line 5—5 of FIG. 3.

The post 132 can support the washers 136, 146, 166, and 170 in various ways. In the illustrated construction, as shown in FIG. 5, the post 132 is molded with the washers 136, 146, 166, and 170 and the wires 144, 148, and 174 in place, with plastic that defines the post 132 extending through the holes 150 in the washers. In this embodiment, the post 132 has an outer diameter that is larger than the diameter of any of the holes 150 through the washers so as to space the washers from one another. Also, the wire 174 passes through the holes through washers 170, 146, and 136, and the wire 148 passes through the holes through washers 146 and 136.

In another embodiment (not shown) the post 132 can be manufactured with four axially spaced, circumferentially extending slots for supporting the washers. In this embodiment, the washers 136, 146, 166, and 170 are each of a split-ring type that can be snapped in one of the slots in the post 132. When one of these washers is mounted in one of the slots in the post 132, a gap is defined where the washer is split. In this embodiment, the wires 174, 148, and 144 extend along the circumference of the post 132. The wire 174 passes through the gaps defined by the washers 170, 146, and 136, and the wire 148 passes through the gaps defined by the washers 146 and 136.

In an alternative embodiment of the invention (not shown), the switches 128 and 130 are momentary, normally open switches and each includes a pushbutton that is movable on an axis, generally normal to the axis 120, between a first position at which the switch is open, and a second position, located closer to the axis 120 than the first position of the pushbutton, at which the switch is closed.

Various features of the invention are set forth in the following claims.

We claim:

1. A tiller arm for a marine propulsion device, said tiller arm comprising a first end adapted to be connected to a propulsion unit, a second end spaced from said first end, and having a longitudinal axis, and a selectively actuatable switch including annular selectively deformable means located on said tiller arm and surrounding said axis and comprising electrically conductive material, said switch including a first electrical contact, and a second electrical contact spaced from said first contact, deformation of said deformable means resulting in said electrically conductive material of said deformable means electrically connecting said first contact to said second contact.

2. A tiller arm in accordance with claim 1 wherein deformation of said deformable means radially inwardly with regard to said axis results in actuation of said switch.

3. A tiller arm in accordance with claim 1 wherein said switch is an electrical switch, is capable only of being in one of an open state and a closed state, and is normally in the open state, and wherein deformation of said deformable means results in said switch being in the closed state.

4. A tiller arm in accordance with claim 1 wherein said first contact is spaced from said second contact along said axis.

5. A tiller arm in accordance with claim 1 wherein said switch is located adjacent said second end of said tiller arm.

6. A marine propulsion device comprising a propulsion unit adapted to be mounted on the transom of a boat for pivotal movement about a generally horizontal tilt axis, selectively actuable means for adjusting the angle of said propulsion unit about said tilt axis, said selectively actuable means including a selectively actuable electric motor, and a hydraulic cylinder-piston assembly driven by said electric motor, and a tiller arm for effecting normal steering movement of said propulsion unit, said tiller arm comprising a first end connected to said propulsion unit, a second end spaced from said first end, and an electrical switch located on said tiller arm adjacent said second end of said tiller arm and operatively connected to said selectively actuable means.

7. A marine propulsion device in accordance with claim 6 wherein said tiller arm has a longitudinal axis, wherein said switch is selectively actuable, and wherein said switch comprises annular selectively deformable means surrounding said longitudinal axis, deformation of said deformable means resulting in actuation of said switch.

8. A marine propulsion device in accordance with claim 7 wherein deformation of said deformable means radially inwardly with regard to said longitudinal axis results in actuation of said switch.

9. A marine propulsion device in accordance with claim 7 wherein said switch is an electrical switch, is capable only of being in one of an open state and a closed state, and is normally in the open state, and wherein deformation of said deformable means results in said switch being in the closed state.

10. A marine propulsion device in accordance with claim 7 wherein said switch comprises a first electrical contact, and a second electrical contact spaced from said first contact, wherein said deformable means includes electrically conductive material, and wherein deformation of said deformable means results in said electrically conductive material of said deformable means electrically connecting said first contact to said second contact.

11. A marine propulsion device in accordance with claim 6 wherein said tiller arm defines a longitudinal axis, wherein said switch includes means movable in a direction generally normal to the longitudinal axis and between a first position that corresponds to said switch being in an open state, and a second position that is closer to the longitudinal axis than is the first position and that corresponds to said switch being in a closed state.

12. A marine propulsion device comprising a propulsion unit adapted to be mounted on the transom of a boat for pivotal movement about a generally vertical steering axis, and for pivotal movement about a generally horizontal tilt axis, first selectively actuable means for adjusting the angle of said propulsion unit about said tilt axis in a first direction, second selectively actuable means for adjusting the angle of said propulsion unit about said tilt axis in a second direction, and a tiller arm including a first end connected to said propulsion unit, a second end spaced from said first end, a longitudinal axis, and a first electrical switch adjacent said second end of said tiller arm, said first switch being capable only of being in one of an open state and a closed state, being normally in the open state, and being operatively connected to said first selectively actuable means, and said tiller arm further including a second electrical switch adjacent said first electrical switch, said second switch being capable only of being in one of an open state and a closed state, being normally in the open state, and being operatively connected to said second selectively actuable means.

13. A marine propulsion device in accordance with claim 12 wherein said first and second selectively actuable means include a selectively actuable electric motor, and a hydraulic cylinder-piston assembly driven by said electric motor, and wherein said assembly extends when said first switch is in said closed state and contracts when said second switch is in said closed state.

14. A marine propulsion device in accordance with claim 12 wherein said first switch comprises a first electrical contact, a second electrical contact spaced from said first contact, and annular selectively deformable electrically conductive means surrounding in spaced relation said first and second contacts, and wherein deformation of said deformable means results in said deformable means electrically connecting said first contact to said second contact.

15. A marine propulsion device in accordance with claim 14 wherein said first contact is spaced from said second contact along said longitudinal axis.

16. A marine propulsion device in accordance with claim 14 wherein said second switch comprises a third electrical contact, and a fourth electrical contact spaced from said third contact, and second annular selectively deformable electrically conductive means surrounding in spaced relation said first and second contacts, and wherein deformation of said second deformable means radially inwardly with regard to said longitudinal axis results in said second deformable means electrically connecting said third contact to said fourth contact.

17. A marine propulsion device in accordance with claim 12 wherein said first switch is adjacent to said second switch.

* * * * *